US005316573A

United States Patent [19]

Brusic et al.

[11] Patent Number: 5,316,573

[45] Date of Patent: May 31, 1994

[54] CORROSION INHIBITION WITH CU-BTA

[75] Inventors: Vlasta A. Brusic, Amawalk; Gerald S. Frankel, Ossining; Tina A. Petersen, Millwood, all of N.Y.; Benjamin M. Rush, Berkeley, Calif.; Alejandro G. Schrott, New York, N.Y.

[73] Assignee: International Business Machines Corporation, Armonk, N.Y.

[21] Appl. No.: 849,856

[22] Filed: Mar. 12, 1992

[51] Int. Cl.[5] ..... C09D 5/08

[52] U.S. Cl. ..... 106/14.16; 106/14.15; 106/14.17; 106/14.44; 252/390; 252/391; 252/394; 252/395

[58] Field of Search ..... 106/14.15, 14.16, 14.17, 106/14.44; 252/394, 395, 390, 391

[56] References Cited

U.S. PATENT DOCUMENTS

| | | | |
|---|---|---|---|
| 3,413,227 | 11/1968 | Howard et al. | 252/51.5 |
| 3,653,931 | 4/1972 | Borchert et al. | 252/394 |
| 3,720,616 | 3/1973 | Randell et al. | 252/51.5 |
| 3,794,603 | 2/1974 | O'Neal, Jr. et al. | 252/389 R |
| 3,887,481 | 6/1975 | Korpics | 252/394 |
| 3,895,170 | 7/1975 | Tanaka et al. | 428/457 |
| 3,985,503 | 10/1976 | O'Neal, Jr. | 252/394 |
| 4,149,969 | 4/1979 | Robitaille et al. | 252/181 |
| 4,184,991 | 1/1980 | Scheurman, III | 106/14.16 |
| 4,202,796 | 5/1980 | Jacob et al. | 106/14.16 |
| 4,395,294 | 7/1983 | Hobbins et al. | 148/6.14 R |
| 4,657,785 | 4/1987 | Kelly et al. | 106/14.16 |
| 4,806,310 | 2/1989 | Mullins et al. | 422/13 |
| 4,821,148 | 4/1989 | Kobayashi et al. | 361/392 |

FOREIGN PATENT DOCUMENTS

| | | | |
|---|---|---|---|
| 49-014056 | 4/1974 | Japan . | |
| 55-007717 | 2/1980 | Japan | 106/14.16 |

*Primary Examiner*—Anthony Green

*Attorney, Agent, or Firm*—Philip J. Feig; Stephen C. Kaufman

[57] ABSTRACT

A corrosion protecting film layer is formed on a non-passivating non-noble metal, such as cobalt, by placing the metal in a dilute solution of $Cu^{+2}$ ions and benzotriazole (1 H-BTA). Exposure of the metal to a solution containing $Cu^{+2}$ and 1 H-BTA results in a spontaneous interaction of $Cu^{+2}$ and the metal to produce a film layer of Cu(I) BTA on the metal surface to create a permanent corrosion protection for the metal. A borate buffer, such as boric acid and a borate, can be added to the solution to adjust the pH of the solution to be in the range between 8 and 9.

17 Claims, No Drawings

CORROSION INHIBITION WITH CU-BTA

BACKGROUND OF THE INVENTION

The present invention relates to corrosion inhibition and particularly to the formation of a thin film of Cu(I)-BTA for inhibiting corrosion of non-passivating, non-noble metals.

Corrosion is a spontaneous process and a ubiquitous problem for all but a few noble metals. Cobalt is particularly susceptible to corrosion. While cobalt forms a marginally protective passive layer in alkaline solutions, nevertheless corrosion occurs at a rate of 0.2 μm/day in DI water with no evidence of passivation. Moreover, cobalt is a non-noble metal and is thus very susceptible to galvanic attack when in contact with other, more noble, metals. Cobalt and its alloys are widely used in magnetic applications due to its exceptional magnetic properties. For example, thin film magnetic disks and thin film inductive magnetic recording heads may be fabricated from cobalt alloys. These products are particularly intolerant of any corrosion loss, both in fabrication and in use.

While there are various known passivation techniques, few are effective at reducing the corrosion rate of cobalt by significant amounts. An important consideration is that any protection technique have no adverse effect upon the magnetic properties of the material. For example, alloying the non-noble metal with an element such as chromium, thermal oxidation methods or the application of conversion layers are all possible methods of passivating non-noble metals. However, each of these methods has undesirable limitations. It is also possible to control unwanted metallic dissolution in fabrication steps where cobalt or its alloys are in contact with process solutions by the use of corrosion inhibitors. However, many corrosion inhibitors offer only a limited protection of a cobalt workpiece in situ, and even less protection after the workpiece is removed from the environment containing the corrosion inhibitor.

Copper, for example, is a more noble metal than cobalt but has an oxide that is an equally marginal surface passivator. Copper is a viable engineering material, largely as a result of the very effective corrosion inhibiting effect provided by benzotriazole (1 H-BTA) and its derivatives. The 1 H-BTA compound reacts with a metallic Cu surface to form a Cu-BTA film. Depending upon the details of the preparation, the film can be as thin as 2 nm thick. Even such a thin film provides effective corrosion inhibiting effect. Once formed, the thin film reduces the corrosion rate of copper in water (with or without the addition of a corrosion inhibitor) by more than two orders of magnitude.

There is no comparably effective inhibitor known in the art for use with cobalt workpieces. In aqueous solutions, benzotriazole chemisorbs on the surface of the cobalt and reduces the corrosion rate by only one order of magnitude. However, when the cobalt workpiece is then placed in a solution devoid of 1 BTA, the corrosion rate is reduced to only 3 to 5 times less than that of a cobalt workpiece not previously exposed to 1 BTA.

SUMMARY OF THE INVENTION

In order to overcome these limitations and provide much improved corrosion inhibiting effect, a thin film containing Cu-BTA is formed on the cobalt containing workpiece.

While the protection afforded by a thin film layer of Cu-BTA on a copper containing workpiece is well known to those skilled in the art, the present invention concerns the formation of such a Cu(I)-BTA film on a non-copper containing, non-passivating, non-noble workpiece by the utilization of a treatment bath containing cupric ions and benzotriazole. The symbol Cu(I) indicates that the copper combining with the benzotriazole is in the +1 oxidation state.

In accordance with the teachings of the present invention, the protective film is formed by exposing the cobalt workpiece to a solution containing $Cu^{+2}$ ions and benzotriazole (1 BTA). As a result of spontaneous interaction of the $Cu^{+2}$ and Co, Cu(I)BTA is formed at the Co surface to form a permanent corrosion protection for the cobalt.

In an alternative method, a borate buffer, that is a solution of boric acid with a borate, such as sodium borate, is added to the $Cu^{+2}$ ions and 1 H-BTA aqueous solution to adjust the pH to be in the range between 8 and 9. The addition of the borate buffer to a BTA+-$Cu^{+2}H_2O$ solution results in a reduction of the corrosion rate of the workpiece during treatment in the cupric ion and 1 H-BTA solution while a Cu(I)-BTA protective film is being formed on the workpiece surface.

The present invention provides for the formation of a corrosion inhibiting film layer on non-passivating, non-noble metals by a simple chemical treatment. The protective film layers includes a Cu(I)-BTA complex.

A principal object of the present invention is, therefore, the provision of a method for forming a corrosion inhibiting layer on non-passivating non-noble metals by a simple chemical treatment.

Another object of the invention is the provision of a method for forming a corrosion inhibiting film layer on a non-passivating, non-noble metal where the film layer includes Cu(I)-BTA.

A further object of the invention is the provision of a solution for depositing a corrosion inhibiting film on a non-passivating, non-noble metal where the bath contains $Cu^{+2}$ ions, 1 H-BTA and a borate buffer for controlling the pH of the bath.

A still further object of the invention is the provision of non-passivating non-noble metal workpiece coated with a thin film corrosion inhibiting layer containing Cu(I)-BTA.

Further and still other objects of the present invention will become more clearly apparent when reading the following description.

DETAILED DESCRIPTION

The present invention concerns the use of a two, and preferably three component system. Specifically, a dilute solution of $Cu^{+2}$ ions and benzotriazole (1 H-BTA), and preferably including a borate buffer, is used to generate a protective film on metals such as cobalt or iron which are normally marginally protected by 1 H-BTA alone. By exposing the metal, such as cobalt, to a solution containing $Cu^{+2}$ ions and 1 H-BTA, a spontaneous interaction of $Cu^{+2}$ and the metal produces a film of Cu(I)BTA at the metal surface to form a permanent corrosion protection for the metal.

The following example describes a preferred bath solution for providing a corrosion inhibiting film layer on a cobalt or cobalt alloy workpiece, where the film layer comprises Cu(I)-BTA.

The cobalt or cobalt alloy workpiece is exposed to an aqueous solution (or distilled or de-ionized water) containing 0.01M 1 H-BTA and low concentrations of cupric ions. A preferred solution contained a range of $1\times10^{-5}$M to $6\times10^{-5}$M $CuSO_45H_2O$.

The open circuit potential of Co in water is normally approximately 400 mV below the reversible potential for Cu oxidation. Thus, cupric ions will tend to undergo reduction on a Co surface. The rate of reduction will be diffusion limited for a dilute solution.

The first step of $Cu^{++}$ reduction in a non-complexing solution is the formation of $Cu^{+}$. The second step would be the formation of metallic Cu from $Cu^{+}$. This is one mechanism for the electrodeposition of Cu.

In the present invention, the second step is prevented by the presence of BTA- in the solution and therefore at the Co surface. The BTA quickly reacts with the $Cu^{+}$ ions to form a thin film layer of Cu(I)-BTA on the workpiece surface. It is important to keep the concentration of the Cu ions low so that the rate of cupric ion reduction stays well below the rate of oxygen reduction which controls the dissolution of Co. The Cu(I)-BTA film thickness, as evaluated by in situ ellipsometry, depends upon the $CuSO_4$ concentration, the pH of the solution, the stirring rate and immersion time. For example, in a solution of water with benzotriazole and $6\times10^{-5}$M $CuSO_4$, stirred by $O_2$ bubbling, the film thickness, grows at a parabolic rate, reaching a thickness of approximately 12 nm in 10 minutes.

Electrochemical data show that the film formed in the described manner is protective of a cobalt workpiece, both in the solution containing benzotriazole and during subsequent exposure to a solution devoid of benzotriazole. The corrosion rate in water is reduced to 4% of the original value as shown in the following Table I.

TABLE I

Corrosion Potential and Rate Measured in a Droplet of Triple Distilled Water

| Workpiece | Corrosion Potential V,MSE | Corrosion Rate A/cm$^2$ |
|---|---|---|
| Co | −0.66 | $1\times10^{-6}$ |
| Co w/Cu(I)-BTA film | −0.82 | $4\times10^{-8}$ |

The fact that the corrosion potential of a cobalt workpiece with a Cu(I)-BTA film layer is lower than the corrosion potential measured on a Co sample without the film layer indicates that the film layer is free of metallic Cu and that it is a stronger barrier for oxygen reduction than normally provided by native oxide.

In a modification of the above described system, the corrosion rate of cobalt during the treatment is even more greatly reduced if a borate buffer, such as boric acid and a borate such as sodium borate, is added to the treatment solution to adjust the pH to be in the range between 8 and 9.

Treatment of a cobalt workpiece in an aqueous solution of 1 H-BTA and a borate buffer does not provide corrosion protection when the workpiece is removed from the solution. Treatment of a cobalt workpiece in an aqueous solution of $CuSO_4$+1 H-BTA provides lasting protection, but the corrosion rate of the workpiece during treatment may be excessively high for certain applications, such as the treatment of small magnetic devices. Treatment of a cobalt workpiece in an aqueous solution of $CuSO_4$1 H-BTA+a boric buffer results in the formation of a lasting protective film layer and a corrosion rate of the workpiece during treatment which is very low.

In an experiment 0.09M boric acid and 0.005M sodium borate was added to an aqueous solution of $Cu^{+2}$+1 H-BTA resulting in a solution having a pH of 8.2. In alkaline solutions such as boric acid/borate buffer and pH of 8.2 or in dilute ammonia and pH in the range of 8.8 to 9, 1 H-BTA alone behaves as an effective corrosion inhibitor for cobalt. Boric acid/borate solution alone does not show a measurable corrosion inhibition of cobalt. However, in the presence of 1 H-BTA, the boric acid/borate buffer appeared to aid in the corrosion inhibition process.

Measurements performed using a cobalt workpiece in a $10^{-5}$M $CuSO_4$ in water with benzotriazole both indicated a reduced Co corrosion rate by a factor of 2× in one minute which increased to a factor of 10× in five minutes. However, in a bath containing $10^{-5}$M $CuSO_4$ and $10^{-2}$M BTA from an alkaline solution with boric acid/borate resulted in a practically instantaneous reduction of Co dissolution by a factor of about 100×. The newly formed protective film layer, CuBTA, was very thin, reaching a thickness of 3.2 nm in 10 minutes.

Once formed, the film layer provides a better permanent protection than that observed with benzotriazole treatment alone.

A solution with $CuSO_4$ and 1 BTA in a borate buffer consumes very small amounts of Co and therefore high concentrations of $CuSo_4$, such as $10^{-3}$M, can be used to produce thicker CuBTA film layers of up to 10 nm and yield even higher factors of permanent corrosion protection of up to two orders of magnitude.

While the above description refers primarily to cobalt and cobalt alloy workpieces, the invention is also applicable to use with other metals and alloys which have a lower open circuit potential than copper. Such metals include, but are not limited to, aluminum, magnesium, iron, manganese, tungsten and zinc, and alloys thereof. Furthermore, the invention is also applicable for use with other benzotriazole derivatives, for example, 5 $CH_3$-BTA and 5 Cl-BTA.

While there has been described corrosion inhibition with a film layer of Cu(I)-BTA, it will be apparent to those skilled in the art that variations and modifications are possible without deviating from the broad spirit and principles of the invention which shall be limited solely by the scope of the claims appended hereto.

What is claimed is:

1. An aqueous solution for forming a corrosion inhibiting film on a non-passivating, non-noble metal or alloy thereof comprising benzotriazole and derivatives thereof and $Cu^{+2}$ ions in small concentrations sufficient for forming a Cu(I)-benzotriazole film without promoting dissolution of said non-noble metal or alloys thereof.

2. An aqueous solution as set forth in claim 1, wherein said $Cu^{+2}$ ions are in a dilute copper salt solution.

3. An aqueous solution as set forth in claim 1 wherein said copper salt is copper sulfate.

4. An aqueous solution as set forth in claim 3 wherein the solution comprises approximately 0.01M of benzotriazole and $CuSO_45H_2O$ in a concentration in the range between $1\times10^{-5}$ and $6\times10^{-5}$M.

5. An aqueous solution as set forth in claim 3 further comprising a borate buffer in sufficient quantity to adjust the pH of the solution to be in the range between 8 and 9.

6. An aqueous solution as set forth in claim 5 wherein said borate buffer comprises both boric acid and a borate.

7. An aqueous solution as set forth in claim 6 wherein said borate is sodium borate.

8. An aqueous solution as set forth in claim 1 further comprising a borate buffer in sufficient quantity to adjust the pH of the solution to be in the range of 8 and 9.

9. An aqueous solution as set forth in claim 8 wherein said borate buffer comprises a solution of both boric acid and a borate.

10. An aqueous solution as set forth in claim 9 wherein said borate is sodium borate.

11. An aqueous solution as set forth in claim 1, wherein said benzotriazole and derivatives thereof is selected from the group consisting of benzotriazole, 5-methyl benzotriazole and 5-chlor-benzotriazole.

12. An aqueous solution as set forth in claim 11, wherein said benzotriazole and derivative thereof is benzotriazole.

13. An aqueous solution for forming a corrosion inhibiting film on cobalt or an alloy thereof comprising approximately 0.01M of benzotriazole and $CuSO_45H_2O$ in a concentration in the range between $1\times10^{-5}$ and $6\times10^{-5}$M.

14. An aqueous solution as set forth in claim 13 further comprising a borate buffer in sufficient quantity to adjust the pH of the solution to be in the range of 8 and 9.

15. An aqueous solution as set forth in claim 14 wherein said borate buffer comprises both boric acid and a borate.

16. An aqueous solution as set forth in claim 15 wherein said borate is sodium borate.

17. An aqueous solution as set forth in claim 3 wherein said non-noble metal or alloy thereof is cobalt or an alloy thereof which does not contain copper and said copper sulfate is in the range of $10\times10^{-5}$ and $6\times10^{-5}$M.

* * * * *